US010602809B2

(12) United States Patent
Mert

(10) Patent No.: US 10,602,809 B2
(45) Date of Patent: Mar. 31, 2020

(54) METHOD OF PRODUCING ELASTIC GARMENTS WITH ZIPPERS

(71) Applicant: Sanko Tekstil Isletmeleri San. Ve Tic. A.S., Inegol-Bursa (TR)

(72) Inventor: Serkan Mert, Inegol-Bursa (TR)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 326 days.

(21) Appl. No.: 15/345,774

(22) Filed: Nov. 8, 2016

(65) Prior Publication Data

US 2017/0127770 A1 May 11, 2017

(30) Foreign Application Priority Data

Nov. 10, 2015 (EP) ..... 15193820

(51) Int. Cl.
*A44B 19/24* (2006.01)
*A41H 37/00* (2006.01)
(Continued)

(52) U.S. Cl.
CPC ..... *A44B 19/24* (2013.01); *A41D 27/00* (2013.01); *A41D 31/00* (2013.01); *A41H 37/003* (2013.01); *A41D 2300/322* (2013.01)

(58) Field of Classification Search
CPC .. A41D 2300/322; A41D 27/00; A41D 31/00; A41H 37/003; A44B 19/24
See application file for complete search history.

(56) References Cited

U.S. PATENT DOCUMENTS 3,487,510 A * 1/1970 Frohlich ..... A44B 19/346 139/384 B
4,876,128 A 10/1989 Zafiroglu
(Continued)

FOREIGN PATENT DOCUMENTS

CN 1046004 10/1990
EP 0292947 11/1988
(Continued)

OTHER PUBLICATIONS

International Search Report and Written Opinion dated Feb. 23, 2017 for PCT/EP2016/076916.
(Continued)

*Primary Examiner* — Anna K Kinsaul
(74) *Attorney, Agent, or Firm* — Silvia Salvadori

(57) ABSTRACT

It is disclosed a method for producing garments comprising separable portions and at least a zipper sewn onto said separable portions of the garment, wherein said garment undergoes shrinkage, preferably by washing, showing a wavy appearance near the zipper before shrinkage and showing a substantially plane appearance after shrinkage. Said method comprising the steps of providing an elastically stretchable zipper, said zipper in its initial un-stretched condition has the length required for the zipper in the final garment; making a garment having separable portions; stretching said zipper; sewing the stretched zipper onto said separable portions of said garment, and shrinking said garment preferably by washing, wherein after said shrinking step, said zipper is in a substantially un-stretched condition. A garment obtainable according to the steps as above is also disclosed.

12 Claims, 3 Drawing Sheets

(51) Int. Cl.
*A41D 27/00* (2006.01)
*A41D 31/00* (2019.01)

(56) References Cited

U.S. PATENT DOCUMENTS

| | | | |
|---|---|---|---|
| 4,924,560 | A | 5/1990 | Matsuda et al. |
| 6,164,227 | A | 12/2000 | Itoh |
| 2013/0174388 | A1 | 7/2013 | Ren |

FOREIGN PATENT DOCUMENTS

| | | |
|---|---|---|
| EP | 15177938.6 | 1/2017 |
| WO | 2016151149 | 9/2016 |

OTHER PUBLICATIONS

International Preliminary Report on patentability dated May 15, 2018 for PCT/EP2016/076916.
European Search Report from parent application EP15193820, dated Apr. 15, 2016.
Office Action issued by the CN Patent Office dated May 20, 2019 for corresponding CN patent application No. 201610991232.7, relevant English translation and Local agent's reporting letter.

* cited by examiner

METHOD OF PRODUCING ELASTIC GARMENTS WITH ZIPPERS

RELATED APPLICATION

This application claims priority to European Application EP 15193820.6, filed 10 Nov. 2015, the contents of which are hereby incorporated by reference as if set forth in their entirety.

FIELD OF THE INVENTION

The present invention relates to the field of textile industry and to the production of garments, comprising a zipper fastened to garment separable portions that are fastened together by the zipper. In particular, the present invention relates to a method for manufacturing garments, comprising garment separable portions and a zipper, subject to shrinkage after washing.

BACKGROUND

A large variety of fabrics and zippers for garments are available and used by the textile industry.

Fabrics for garments can be stretchable, elastic or rigid. Materials available for garment fabrics comprise plant textiles, animal textiles, synthetic textiles, artificial textiles and mineral textiles.

The manufacturing processes for producing garments comprise treatments of fabrics such that, depending on the typology of the fabric, when the fabric of the garment is washed, it may undergo to shrinkage. In particular, bi-stretch material fabrics present a considerable shrinkage, up to 20%, after washing. The term "bi-stretch material" used before and hereinafter refers to an elastic material fabric used especially for denim garment, that can be stretched along the warp and weft directions.

Zippers, zip fasteners or clasp locker, are common devices used for binding the edges of any separable portions that define an opening in a garment; a typical example of separable portions are fly pieces of fabrics in garments. A zipper comprises zipper teeth and a zipper tape. Different materials are available for zippers teeth and zippers tapes. Typically, zippers teeth materials include nylon coil, metal and plastic teeth, while zippers tapes materials include polyester, nylon and many other woven elastic and non-elastic materials.

When a zipper is fastened to the garment's separable portions and then the garment is washed, the zipper and the fabric to which the zipper is fastened, may undergo a different shrinkage. In particular, if the zipper tape material is, as commonly used, polyester, the zipper does not shrink or shrinks very little. On the contrary, if the fabric of the garment is a mono or bi-stretch material, it will undergo shrinkage after washing. In general, when the fabric of the garments and the zipper tape undergo washing, there occurs a different shrinkage of the fabric and the zipper that generates wavy-looking folds on the region of the garment where the zipper has been sewn. The term "wavy-looking folds" used before and hereinafter, refers to a corrugated region of the garment where the fabric and/or the zipper shrink forming a substantially oscillating profile. As a result, the undesired wavy-looking folds aesthetically ruin the design of the garment. Moreover, this may cause a malfunctioning of the zipper since the zipper has to slide through wavy-looking folds of the tape.

Since non-elastic zippers, such as 100% polyester zippers, do not shrink after washing, the application of such zipper to a fabric that does not shrink after washing, does not generates any problem. However, if the fabric of the garment undergoes shrinkage after washing, the application of a non-elastic or an elastic zipper will produce a corrugated region in the garment.

In fact, in the case of a zipper applied on stretchable garment separable portions, after washing the garment, the separable portions undergo shrinkage, while the non-elastic zip does not. Therefore, the shrinkage of the garment separable portions generates the wavy-looking folds described before.

The problem of garment shrinkage after washing, in particular referring to the wavy-looking folds on the region where the zipper is sewn, is also disclosed in CN2513408Y. The malfunctioning of the zipper caused by the wavy-looking folds on the garment can be solved by providing the zipper structure with a head body comprising a pull tab so that when the tab is pulled by the zipper, it provides a levelling effect that improves the zipper scroll when it is slid to a closed or open position.

However, even if this solves the problem of the zipper malfunctioning under the fabric shrinkage after washing, the fabric and the zipper tape still present undesired wavy-looking folds. This problem persists both in the open and closed condition of the zipper, causing an unpleasant wavy-look of the garment in correspondence of the zipper.

SUMMARY OF THE INVENTION

An aim of the present invention is to overcome the problems of the prior art above cited and to provide a method of producing garments where the fabric and the zipper tape do not generate any wavy-looking folds after washing. Suitable garments are known in the art, e.g. trousers, pants, shirts, jeans, sportswear garments, hoodies and similar cloths.

Suitable fabrics are fabrics that undergo a shrinkage after washing, preferably a shrinkage that is at least 5% of the initial length, more preferably of at least 10% of the initial length of the fabric. Preferred fabrics are elastic fabrics such as the fabrics disclosed in EP15177938 and EP15161213, both in the name of the present applicant. A further object of the present invention is to provide a denim garment that comprises a shrinkable fabric and at least an elastic zipper.

With the term "elastic zipper", it is meant a zipper that can be stretched along its longitudinal direction, i.e. its length, without losing its functionality. An elastic zipper may also be a zipper that can be stretched along its longitudinal and transversal direction, i.e. along its length and width, without losing its functionality.

According to a first embodiment, the elastic zipper is a zipper entirely stretchable, i.e. stretchable in all its portions, including the engaging portion where the zipper teeth are provided.

According to another embodiment, the elastic zipper is a zipper partially stretchable, i.e. stretchable in one or more of its portions. In an embodiment, the zipper has an unstretchable engaging portion and a stretchable zipper tape portion. The two portions may be made of different materials.

The aims of the present invention are reached by means of a method of producing garments according to claim 1 and related dependent claims, and by a garment according to claim 8 and the related dependent claims.

In particular, according to the present invention, the method of producing garments comprises the step to fasten an elastically stretchable zipper to separable portions of a garment in a stretched condition before washing the garment. Separable portions are portions of the garment that are to be connected and disconnected by means of the zipper; as is known, the zipper is sewn to the portions so that a closed zipper holds together the separable portions, which can be separated again by opening the zipper. An example of separable portions in a garment are the portions in a jeans that are found adjacent to a fly piece.

According to the present invention, the length of the elastic zipper at its initial condition is shorter than the length of the garment separable portions in their initial condition. More in detail, the initial length of the zipper, i.e. the length of the zipper when it is not stretched (or elongated) is selected to match the length required for a zipper that can connect the separable portions of the garment in its final condition; a final condition of the garment is after shrinking, preferably shrinking by washing. The length of the zipper may be substantially corresponding to the length of the separable portions, but it may be less, provided the portions are effectively held together. In the following description, for sake of simplicity, it will be assumed that the required length of the zipper (unstretched) is the length of the garment separable portions after the washing shrinkage. Because it is known how much the fabric will shrink in percent of the initial length, e.g. upon washing, it is possible to predict, i.e. foresee, which will be the length of the separable portions of the garment and, therefore which will be the length required for the zipper that is going to be sewn on the separable portions.

According to the present invention, before washing the garment, the zipper is sewn to the garment separable portions in a stretched condition in order to overcome, i.e. compensate, the foreseen garment shrinkage after washing. More in detail, the elastic zipper is opened and is stretched from its original condition to the length of the garment separable portions before washing. Therefore, before the wash, the elastic zipper is in a stretched condition along its longitudinal direction, but after the wash, the fabric of the garment including the separable portions, shrinks and the zipper fastened to the garment separable portions shrinks accordingly. As a result, the zipper shrinks to an un-stretched condition, and the garment separable portions shrinks after the wash, so that the zipper and the garment separable portions have substantially the same length. The thus obtained separable portions provided with the zipper are substantially plane and have a substantially flat appearance. As mentioned, the final length of the zipper is the same, or substantially the same, as the initial length of the zipper.

According to the present invention, the zipper is fastened to the garment separable portions in a stretched condition, which may be corresponding to at least the 110% of its original length. According to a preferred embodiment of the present invention, the zipper is fastened to the garment separable portions in a stretched condition corresponding to 125% of its original condition. In fact, according to an exemplary embodiment of the present invention, a bi-stretch denim fabric may undergo shrinkage up to 20% of its original value. For this reason, the zipper in its original condition is 20% shorter than the length of the garment separable portions before the wash. From this original condition, the zipper will reach the length of the garment separable portions before the wash, after a stretch of a value corresponding to 25% of the initial value, i.e. to reach a stretched length that is 125% of its original length.

In a possible embodiment, when x is the known percent of shrinkage of the fabric in the garment, expressed as decimals, (e.g. 20% being expressed as 0.20), the elongation obtained by stretching the zipper is calculated with the formula $$\frac{x}{1-x}.$$

In the above example, the elongation of the zipper required for use with a fabric that shrinks by a value of 20% is:

$$\frac{0.20}{1-0.20} \text{ i.e. } \frac{0.20}{0.80}$$

which gives 0.25. This means that the zipper has to be stretched of a value corresponding to 25% of its initial length, so as to reach a length that is 125% of its initial length.

The elastic zipper according to the present invention may be any elastic zipper with nylon coils, plastic or metal teeth, preferably with metal teeth. The elastic zipper is required to be stretchable at least along its length. The scope of the present invention encompasses also elastic zippers stretchable along its length and its width.

According to another aspect of the present invention, it is disclosed a garment comprising a fabric which may be any of the fabrics that undergo shrinkage after washing and it is not limited to the particular embodiment of denim garments. The garments also comprises at least a zipper sewn onto the garment separable portions, where said zipper is an elastic zipper.

According to another aspect of the present invention, the garment comprises at least a zipper and a fabric requiring washing and undergoing shrinkage after washing, said garment shows a wavy appearance in correspondence of the zipper before the shrinkage (usually by washing), and does not show a wavy appearance in correspondence of the zipper after the wash.

According to another aspect of the present invention, the garment comprises a zipper that is a metal type zipper. Other embodiments of the present invention may also comprise plastic or nylon coils zippers.

According to another aspect of the present invention, the garment comprises an elastic zipper that can be stretchable at least by 10% (i.e. the zipper reaches a stretched condition corresponding to at least the 110% of its original length), preferably by 25% or more (i.e. the zipper reaches a stretched condition corresponding to 125% of its original length, or more). In fact, the elastic zipper, according to the an exemplary embodiment present invention, has to be stretched up to 25% before sewing, in order to undergo the foreseen shrinkage of the bi-stretch denim material fabrics up to the 20% of its original condition.

BRIEF DESCRIPTION OF THE DRAWINGS

Further aspects and advantages of the present invention will be discussed more in detail with reference to the enclosed drawings, given by way of non-limiting example, wherein.

DETAILED DESCRIPTION

FIG. 1*a-e* show schematic representations of consecutive steps of the method of producing a washable garment 3 with a zipper 1, according to the present invention. The garment 3 does not show wavy-looking folds in the region of the garment in correspondence of the zipper 1 and the garment separable portions 2*a,b*, after washing the garment 3.

Figure 1A:
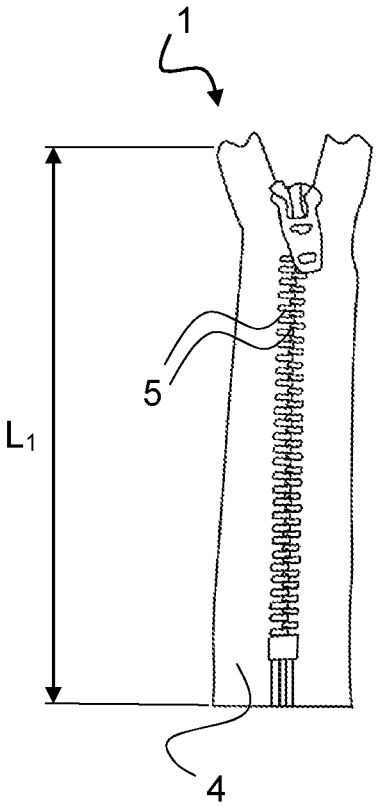
FIGS. 1*a-e* are schematic views of the zipper and the garment used in the method of producing washable garments with zippers according to the present invention.
Figure 1B:
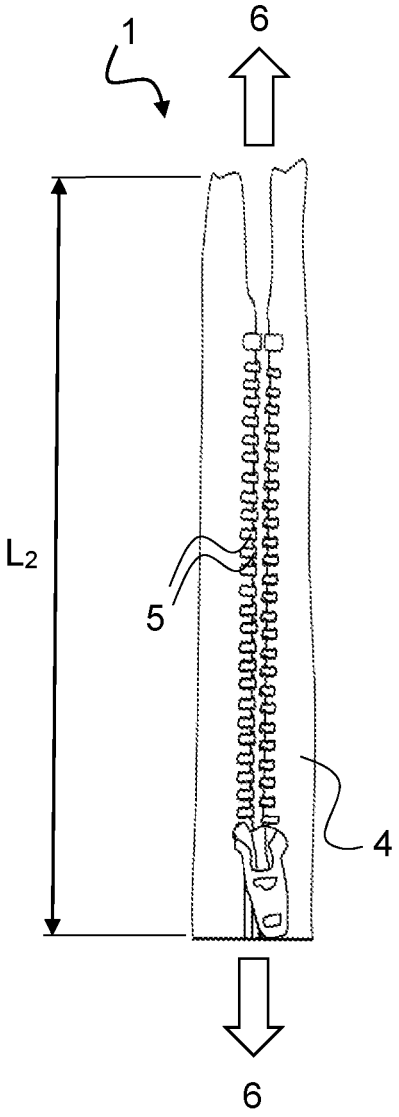

The elastic zipper 1 shown in FIGS. 1*a-e* is a zipper of the type comprising metal teeth 5 and an elastic tape 4 stretchable at least along its longitudinal direction, i.e. along its length. Other embodiments of the present invention also encompass elastic zippers of the type comprising plastic teeth or nylon coils and elastic tapes stretchable along their longitudinal and transversal direction, i.e. along their length and width. FIG. 1*a* shows the elastic zipper 1 at its initial un-stretched condition, according to the present invention. The elastic zipper 1 at its initial un-stretched condition is longitudinally smaller than the garment separable portions 2*a,b* where the zipper will be sewn, because according to the present invention, the zipper 1 will be longitudinally stretched, as shown in FIG. 1*b*, before being sewn onto the garment 3. In particular, the initial length of the elastic zipper 1 is L1 and the length of the garment separable portions 2*a,b* is L2, where L1 is shorter than L2. In other words, the elastic zipper 1 is stretched along its length, in a longitudinal direction from a length L1 to a length L2. According to the present invention, the elastic zipper length L1 corresponds to the foreseen length of the garment separable portions 2*a,b* after washing and undergoing shrinkage.

According to an exemplary embodiment of the present invention, the elastic zipper 1 is 20% shorter than the length of the garment separable portions 2*a,b* where it will be sewn, since it is foreseen a washing shrinkage up to the 20% of the fabric of a bi-stretch denim garment that is taken as an exemplary fabric undergoing a considerable shrinkage.

Figure 1C:
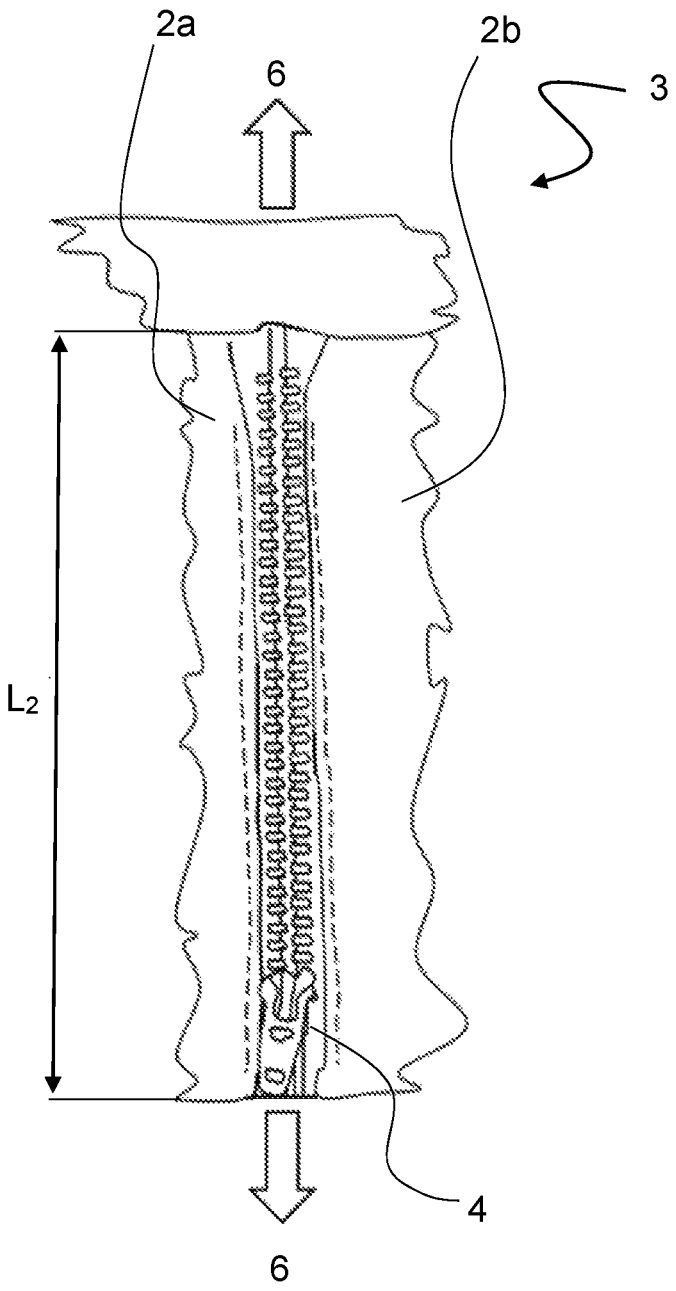

In FIG. 1*b* the elastic zipper 1 is longitudinally stretched until it reaches the length L2 correspondent to the garment separable portions 2*a,b* onto which the zipper will be sewn. The elastic zipper is stretched at its open condition, since it has to be possible to let the elastic zipper tape 4 to be stretched without the constraint of the zipper teeth 5. The tension applied on the elastic zipper is represented in FIGS. 1*b-c* by arrows 6. Once the elastic zipper 1 is stretched, it is kept at the stretched condition, corresponding to the length L2, while it is sewn onto the garment separable portions 2*a,b*. FIG. 1*c* shows the elastic zipper 1 sewn onto the garment separable portions 2*a,b* in its open condition, according to the present invention. The garment separable portions 2*a,b* are not tensioned while the elastic zipper is sewn onto the garment. In other words, only the elastic zipper 1 is tensioned during the sewing operation and it is kept tensioned so that the zipper length during the sewing operation corresponds to the length L2 of the separable portions 2*a,b* of the garment 3 before they the garment is shrunk.

Figure 1D:
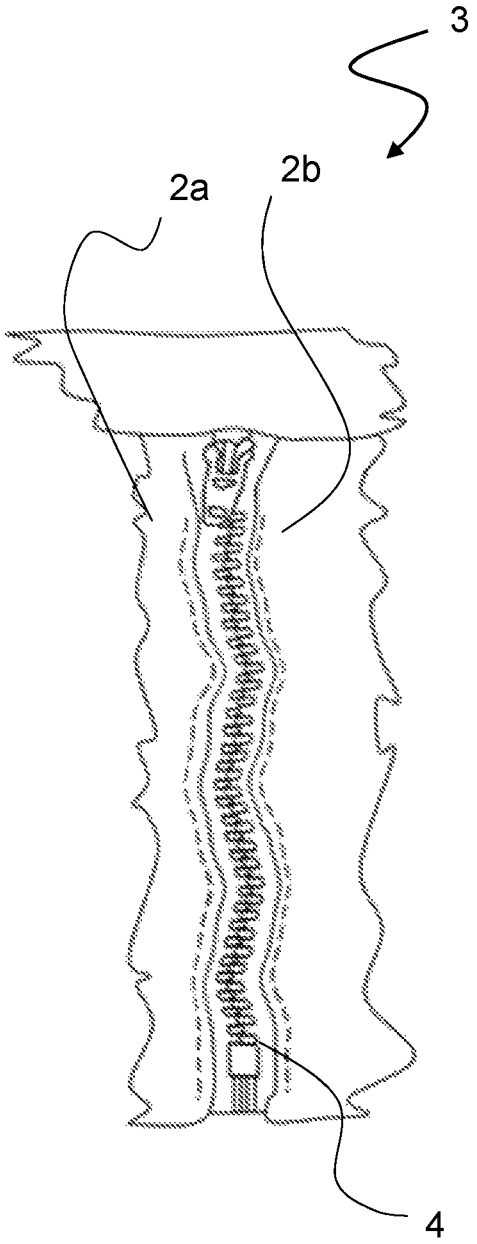

FIG. 1*d* shows the garment 3 after releasing the tension forces 6 on the elastic zipper 1 already sewn onto the garment separable portions 2*a,b* and after closing the zipper. Since tension forces 6 are not applied to the zipper 1, it will shrink because of the elastic contraction of the zipper tape 4 along its longitudinal direction. The shrinkage of the elastic zipper causes the wavy-looking folds of the region of the garment 3 where the zipper 1 is sewn; the waves, i.e. the undulation of the fabric, mainly occurs in a direction that is vertical with respect to the plane of the fabric.

At this point, the garment 3, comprising the elastic zipper 1 and the garment separable portions 2*a,b* in the wavy-looking corrugated state, is washed according to the present invention.

After washing, the fabric of the garment 3 undergoes shrinkage and the garment separable portions 2*a,b* reduce them length from L2 before washing, to L1 after washing. According to the exemplary embodiment of the present invention, the bi-stretch denim fabric undergoes shrinkage of about 20% of its initial condition. The elastic zipper is not affected by washing shrinkage but since it is elastic, it will go back to its initial un-stretched condition naturally. In other words, the elastic zipper stretched to the length L2 comes back to its initial un-stretched length L1. According to the present invention, the garment separable portions 2*a,b* and the elastic zipper 1 are of the same length L1 after the wash, without showing wavy-looking folds.

By resuming, the method of producing the garment 3 according to the present invention comprises the following steps:

(a) Longitudinally stretching an elastic zipper 1 at its open condition from a length L1 corresponding to the foreseen length of the separable portions 2*a,b* of garment 3 that undergo shrinkage after washing, to a length L2 corresponding to the length of the separable portions 2*a,b* of the garment 3 before washing;

(b) Sewing the elastic zipper 1 onto separable portions 2*a,b* of the garment 3, where the elastic zipper 1 is in a stretched and open condition and the garment separable portions 2*a,b* are not stretched during sewing. Both the stretched elastic zipper 1 and the garment separable portions 2*a,b* are long L2;

(c) Washing the garment 3 comprising the elastic zipper 1 sewn onto the garment separable portions 2*a,b*. Before washing the garment 3, the zone of the garment in correspondence of the elastic zipper 1 shows wavy-looking folds due to the elastic zipper contraction after releasing the zipper 1 once it is sewn onto separable portions 2*a,b*; after washing the garment 3, the zone of the garment in correspondence of the elastic zipper 1 does not show wavy-looking folds since the fabric of the garment 3 undergoes shrinkage during washing. The elastic zipper 1 and the garment separable portions 2*a,b* of the garment 3 after the wash, are of the same length L1.

Figure 1E:
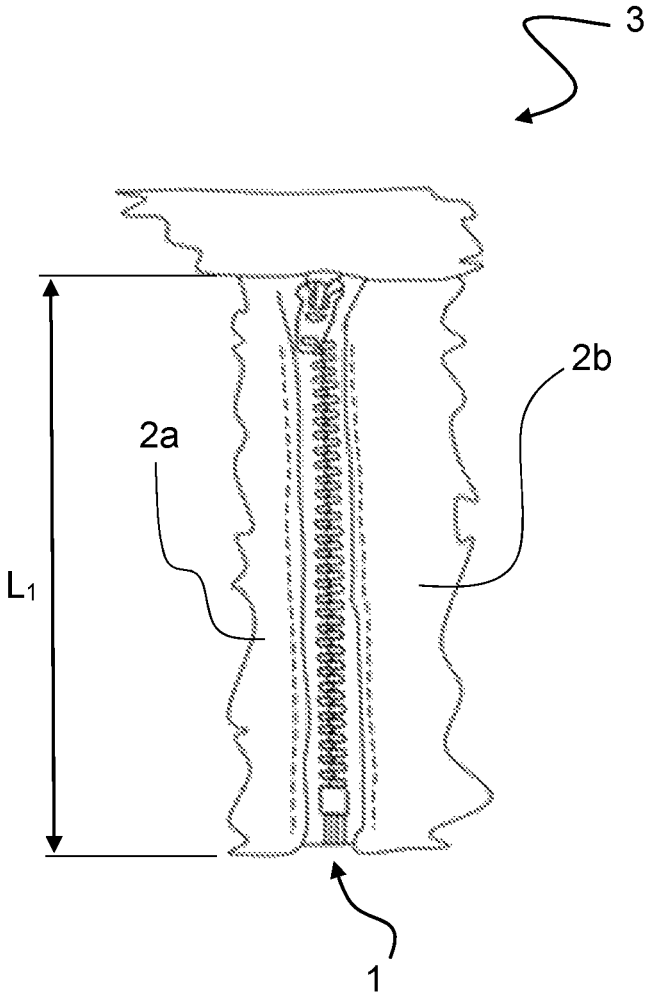

FIG. 1*e* shows the product of the garment 3 after washing, according to the present invention, comprising the elastic zipper 1 fastened to the garment separable portions 2*a,b*. The fabric of the garment 3 is of the type that requires washing and that undergoes shrinkage after washing. The garment 3 in the final condition does not show wavy-looking folds in correspondence of the elastic zipper 1, but shows wavy-looking folds before washing. The wavy-looking folds before washing are caused by the elastic zipper 1 contraction after sewing the zipper and releasing of the tensioning forces.

As a result the elastic zipper 1 and the separable portions 2*a,b* of the garment 3 after washing are not tensioned, they are flat and have substantially the same length L1.

The invention claimed is:

1. A method for producing a garment, said garment having separable portions and at least a zipper sewn onto said separable portions of said garment, said method comprising:

a) providing an elastically stretchable zipper, said zipper in its initial un-stretched condition having a length L1 required for the zipper in a final garment;

b) providing a garment having separable portions, said garment being made of a fabric that undergoes a shrinkage after washing that is at least 5% of the initial length of said fabric, the shrinkage upon washing of the fabric being different from the shrinkage upon washing of the zipper;

c) stretching said zipper to a length under tension that is greater than the initial non-tensioned length L1;

d) sewing the stretched tensioned zipper onto said separable portions of said garment before said garment undergoes a shrinkage; and e) washing said garment whereby said garment fabric undergoes a shrinking step, wherein after said shrinking step, said zipper is in a substantially un-stretched initial condition and has said length L1.

2. The method according to claim 1, wherein said separable portions have length L2 and said zipper is stretched at least along its length in a longitudinal direction from said length L1 to said length L2.

3. The method according to claim 1, wherein after the stretched zipper is sewn on said separable portions, tension on said zipper is removed whereby the elastic zipper shrinks to said initial length L1 and provides to said garment a wavy appearance along the zipper before the washing and shrinking step of said garment.

4. The method according to claim 1, wherein said zipper is sewn onto said garment separable portions in a stretched condition corresponding to a length required for said zipper to be sewn on said garment separable portions before said shrinking.

5. The method according to claim 1, wherein said zipper length L1 of the zipper in a stretched condition is to at least 110% of the un-stretched length L1 of said zipper.

6. The method according to claim 4, wherein said zipper is stretched at least along its longitudinal direction.

7. The method according to claim 1, wherein the zipper is closed after said shrinking.

8. A garment formed according to the method of claim 1, said garment comprising at least a zipper sewn onto separable portions of the garment, characterized in that said zipper is elastically stretchable along its length and in the final garment the length of the zipper sewn on the fabric and the length of the separable portions correspond to the length of the zipper in a non-tensioned condition.

9. The garment according to claim 8, wherein said zipper is sewn onto said garment separable portions in a stretched condition corresponding to at least 110% of an un-stretched length of said zipper.

10. The garment according to claim 8, wherein said zipper is a metal zipper and said garment fabric is an elastic fabric.

11. The method according to claim 1, wherein said zipper is sewn onto said separable portions in a stretched condition corresponding to about 125% of an un-stretched length of said zipper.

12. The garment according to claim 8, wherein said zipper is sewn onto said separable portions in a stretched condition corresponding to about 125% of an un-stretched length of said zipper.

* * * * *